US009666926B2

(12) United States Patent
Futabatake et al.

(10) Patent No.: US 9,666,926 B2
(45) Date of Patent: May 30, 2017

(54) POWER SUPPLY LINE FOR HIGH-FREQUENCY CURRENT, MANUFACTURING METHOD FOR SAME, AND POWER SUPPLY LINE HOLDING STRUCTURE

(75) Inventors: Yasushi Futabatake, Osaka (JP); Hiroshi Maeda, Osaka (JP); Kouichi Teraura, Hyogo (JP); Yukihiro Matsunobu, Osaka (JP); Masato Toki, Mie (JP); Shinji Hara, Osaka (JP)

(73) Assignee: PANASONIC CORPORATION (JP)

( * ) Notice: Subject to any disclaimer, the term of this patent is extended or adjusted under 35 U.S.C. 154(b) by 451 days.

(21) Appl. No.: 13/499,298

(22) PCT Filed: Sep. 28, 2010

(86) PCT No.: PCT/IB2010/002426

§ 371 (c)(1),
(2), (4) Date: Mar. 30, 2012

(87) PCT Pub. No.: WO2011/039602

PCT Pub. Date: Apr. 7, 2011

(65) Prior Publication Data

US 2012/0193123 A1 Aug. 2, 2012

(30) Foreign Application Priority Data

Sep. 30, 2009 (JP) ..... 2009-227421
Sep. 30, 2009 (JP) ..... 2009-227422

(51) Int. Cl.
*H01B 5/00* (2006.01)
*H01R 43/00* (2006.01)
*H01P 3/06* (2006.01)

(52) U.S. Cl.
CPC ..... *H01P 3/06* (2013.01); *Y10T 29/49117* (2015.01)

(58) Field of Classification Search
CPC ..... H01P 3/00; H01P 3/06
(Continued)

(56) References Cited

U.S. PATENT DOCUMENTS 3,110,754 A * 11/1963 Witort ..... H02G 3/0481 138/114
4,092,485 A * 5/1978 Wanser ..... 174/28
(Continued)

FOREIGN PATENT DOCUMENTS

JP 2008117746 5/2008
JP 2008-142663 A 6/2008
(Continued)

OTHER PUBLICATIONS

The International Search Report for PCT/IB2010/002426.
Office Action dated May 23, 2013 issued in corresponding Korean application No. 10-2012-7009108 (w/English summary thereof).

*Primary Examiner* — William H Mayo, III
*Assistant Examiner* — Hiram E Gonzalez
(74) *Attorney, Agent, or Firm* — Bacon & Thomas, PLLC

(57) ABSTRACT

A power supply line for high-frequency current has a two-layered tubular conductor including an inner tube portion and an outer tube portion which is concentric to the inner tube portion and integrally linked thereto by four connecting portions along the entire length in the longitudinal direction. The four connecting portions are circumferentially disposed at predetermined intervals. By providing the four connection portions between the inner tube portion and the outer tube portion, it is possible to more accurately position the inner tube portion and to reduce high frequency resistance when compared with the likes of conventional power supply lines for high-frequency current having only one connecting portion between an inner tube portion and an outer tube portion.

8 Claims, 16 Drawing Sheets

(58) Field of Classification Search
USPC ..... 174/126.1
See application file for complete search history.

(56) References Cited

U.S. PATENT DOCUMENTS

| | | | | | |
|---|---|---|---|---|---|
| 4,414,424 | A | * | 11/1983 | Mizoguchi et al. | 174/28 |
| 4,521,755 | A | * | 6/1985 | Carlson et al. | 333/244 |
| 4,705,914 | A | * | 11/1987 | Bondon | 174/28 |
| 7,156,126 | B2 | * | 1/2007 | Topek et al. | 138/117 |
| 7,239,219 | B2 | * | 7/2007 | Brown et al. | 333/156 |
| 8,796,552 | B2 | * | 8/2014 | Faulkner et al. | 174/88 R |
| 2008/0197946 | A1 | * | 8/2008 | Houck et al. | 333/243 |

FOREIGN PATENT DOCUMENTS

| | | | |
|---|---|---|---|
| JP | 2008226778 | A | 9/2008 |
| JP | 2009227169 | A | 10/2009 |
| JP | 2009227170 | A | 10/2009 |
| KR | 10-2008-0014743 | A | 2/2008 |
| WO | 2007125686 | A1 | 11/2007 |

* cited by examiner

POWER SUPPLY LINE FOR HIGH-FREQUENCY CURRENT, MANUFACTURING METHOD FOR SAME, AND POWER SUPPLY LINE HOLDING STRUCTURE

FIELD OF THE INVENTION

The present invention relates to a power supply line for high-frequency current through which a high-frequency current flows, a power supply line manufacturing method and a power supply line holding structure for holding the power supply line.

BACKGROUND OF THE INVENTION

Conventionally, there is available a trolley system including a vehicle, such as a travelling hoist or a transfer mover, and a power supply device for supplying electric power to the vehicle. In the power supply device, electric power is exchanged between a power supply line arranged along a vehicle-travelling rail and a power receiver provided in the vehicle. The electric power received by the power receiver is supplied to the vehicle. One example of the power supply line is disclosed in Patent Document 1.

FIG. 12 is a perspective view showing the outward appearance of a power supply line for high-frequency current disclosed in Patent Document 1. FIG. 13 is a vertical section view showing a modified example of the power supply line shown in FIG. 12, which employs another conductor formed by extruding copper. As shown in FIGS. 12 and 13, the power supply line for high-frequency current 100 includes a two-layered tubular conductor 200 embedded in an insulating body 300. The conductor 200 includes an inner tube portion 200*a* and a concentric outer tube portion 200*b* one-piece connected to the inner tube portion 200*a* by a connecting portion 200*c* over the longitudinal full length of the conductor 200. The insulating body 300 is not arranged in the spatial portions 400*a* and 400*b* of the respective tube portions 200*a* and 200*b*.

In the example shown in FIG. 12, a conductor 200 is formed by, e.g., bending a single copper plate. More specifically, an inner tube portion 200*a* is formed by bending the central portion of a plate into an annular cross-sectional shape. Two planar piece portions extending downward in FIG. 12 from the opposite ends of the annular portion forming the inner tube portion 200*a* are formed in a parallel-extending contact relationship with each other. An outer tube portion 200*b* of annular cross-sectional shape concentric with the inner tube portion 200*a* is formed by bending the planar piece portions into an arc shape to surround the inner tube portion 200*a*, bringing the ends of the arc-shaped bent portions into contact with each other and welding the ends of the arc-shaped bent portions together. The two planar piece portions formed in a parallel-extending contact relationship make up a connecting portion 200*c* for interconnecting the inner and outer tube portions 200*a* and 200*b*.

In a trolley system, power supply lines are fixed in place by a line hanger 500 as shown in FIGS. 14 and 15. FIG. is a perspective view showing a state that two power supply lines 101 are fixed to a conventional line hanger 500. FIG. 15 is a front view of the line hanger 500 shown in FIG. 14. As shown in FIGS. 14 and 15, the line hanger 500 is used to fix the power supply lines 101 having a circular cross-sectional shape. The line hanger 500 is formed into a substantially U-like shape and includes a pair of holding members 501 and 502 for holding a pair of power supply lines 101 arranged in parallel and a connecting portion 503 for interconnecting the base end portions of the holding members 501 and 502. In the tip end portions of the holding members 501 and 502, there are formed recess portions 501H and 502H for holding the power supply lines 101. The recess portions 501H and 502H are formed into a shape conforming to the outward shape of the power supply lines 101, i.e., the cross-sectional shape of sheaths 301 of the power supply lines 101. Thus, the recess portions 501H and 502H can hold the power supply lines 101 in a closely contacted state with no looseness.

FIG. 16 shows the recess portion 501H (or 502H) of the holding member 501 (or 502) shown in FIG. 14 and the power supply line 101 held in the recess portion 501H (or 502H). As shown in FIG. 16, step-like stoppers 501Ha (or 502Ha) are formed inside the recess portion 501H (or 502H) of the holding member 501 (or 502). The power supply line 101 is locked by the stoppers 501Ha (or 502Ha) and is prevented from being removed with ease.

[Patent Document 1]

Japanese Patent Application Publication No. 2008-117746

However, the power supply line for high-frequency current disclosed in Patent Document 1 suffers from the following problems.

(1) Since the inner tube portion and the outer tube portion are connected by the single connecting portion, the positioning of the inner tube portion becomes unstable and the alternating current resistance tends to increase. In this regard, the high-frequency resistance becomes smallest when the inner and outer tube portions are concentric with each other.

(2) A higher level of technique and an increased cost are required to form the inner tube portion, the outer tube portion and the connecting portion using a single copper plate.

(3) Copper is harder than aluminum, poor in extrusion formability (namely, throughput) and expensive.

The line hanger set forth above suffers from the following problem. Despite the fact that the step-like stoppers are formed in the recess portion of the holding member of the line hanger, the power supply line having a sheath of circular cross-sectional shape is easily removed upward from the holding member.

Since the holding member of the line hanger is not provided with a structure for restraining the power supply line from rotating in the circumferential direction, a problem is posed in that the power supply line is rotated when installed or repaired, which makes it difficult to keep the power supply line in position.

SUMMARY OF THE INVENTION

In view of the above, the present invention provides a power supply line for high-frequency current and a power supply line manufacturing method, which are capable of increasing the positioning accuracy of an inner tube portion with respect to an outer tube portion and capable of enhancing the forming throughput.

Furthermore, the present invention provides a power supply line holding structure for use in a system such as a trolley system employing a line hanger for fixing a power supply line, which is capable of preventing the power supply line from being removed upward and capable of reliably performing the positioning of the power supply line.

In accordance with a first aspect of the present invention, there is provided a power supply line for high-frequency current, which includes a conductor including an inner tube portion, an outer tube portion and a plurality of connecting portions provided between the inner tube portion and the outer tube portion.

With such configuration, the connecting portions are provided between the inner tube portion and the outer tube portion. It is therefore possible to increase the positioning accuracy of the inner tube portion and to reduce the high-frequency resistance.

The connecting portions may preferably include raised connecting portions formed on the inner tube portion, the raised connecting portions making contact with an inner surface of the outer tube portion. With such configuration, the inner tube portion and the outer tube portion are formed independently of each other. This makes it possible to enhance the forming throughput and to save the cost.

The outer tube portion may preferably include guide grooves formed on the inner surface thereof, the raised connecting portions engaging with the guide grooves. This makes it possible to increase the positioning accuracy of the inner tube portion. More specifically, depending on the machining accuracy of the inner surface of the outer tube portion, a deviation may sometimes occur in the position of the inner tube portion if the inner tube portion is rotated with respect to the outer tube portion in the circumferential direction. By fixing the position of the inner tube portion with respect to the outer tube portion, it is possible to prevent the inner tube portion from being deviated in position from the outer tube portion. It goes without saying that the positional deviation may be caused by the machining accuracy of the tip ends of the raised connecting portions as well as the machining accuracy of the inner surface of the outer tube portion.

The raised connecting portions may preferably be pressed against the inner surface of the outer tube portion. This makes it possible to increase the positioning accuracy of the inner tube portion.

In accordance with a second aspect of the present invention, there is provided a method for manufacturing a power supply line for high-frequency current, comprising: providing an inner tube portion having a plurality of raised connecting portions formed on an outer surface thereof; fitting an outer tube portion onto the inner tube portion, the outer tube portion having an inner surface surrounding the raised connecting portions; and reducing the diameter of the outer tube portion to obtain a conductor in which the raised connecting portions make contact with the inner surface of the outer tube portion.

With such configuration, the inner tube portion and the outer tube portion are connected by the raised connecting portions formed on the outer surface of the inner tube portion. It is therefore possible to increase the positioning accuracy of the inner tube portion and to reduce the high-frequency resistance. Since the inner tube portion and the outer tube portion are formed independently of each other, it is possible to enhance the forming throughput and to save the cost as compared with a case where the inner tube portion and the outer tube portion are one-piece formed from a single copper plate.

The number of the raised connecting portions may preferably be three or more. This makes it possible to increase the positioning accuracy of the inner tube portion.

Guide grooves engaging with the raised connecting portions may preferably be formed on the inner surface of the outer tube portion. This makes it possible to further increase the positioning accuracy of the inner tube portion.

The raised connecting portions may preferably be pressed against the inner surface of the outer tube portion by reducing the diameter of the outer tube portion. This makes it possible to prevent the inner tube portion from being deviated in position with respect to the outer tube portion.

In accordance with a third aspect of the present invention, there is provided a power supply line holding structure, including: a holding member including a recess portion with a stopper; and a power supply line including a sheath having a substantially circular cross-sectional shape, the power supply line being mounted to the recess portion of the holding member, the sheath having a flat shoulder portion engaging, through surface-to-surface contact, with the stopper of the recess portion.

With such configuration, when the power supply line is fixed to the recess portion of the holding member, the flat shoulder portion of the sheath of the power supply line are caught, through surface-to-surface contact, by the stopper of the recess portion. This makes it possible to prevent the power supply line from being removed upward or making rotation. It is therefore possible to reliably perform the positioning of the power supply line.

The recess portion of the holding member may preferably have an inner surface and a groove formed on the inner surface, the sheath of the power supply line having a protrusion engaging with the groove. Employing this structure makes it possible to more reliably perform the positioning of the power supply line.

In accordance with a fourth aspect of the present invention, there is provided a power supply line holding structure, including: a holding member including a recess portion; and a power supply line including a sheath having a substantially circular cross-sectional shape, the power supply line being mounted to the recess portion of the holding member, the recess portion of the holding member having an inner surface and a protrusion formed on the inner surface, the sheath having a groove engaging with the protrusion of the recess portion.

With such configuration, when the power supply line is fixed to the recess portion of the holding member, the protrusion provided in on the inner surface of the recess portion engages with the groove provided in the sheath of the power supply line. This makes it possible to reliably prevent the power supply line from being removed upward or making rotation. It is therefore possible to more reliably perform the positioning of the power supply line.

The present invention can provide a power supply line for high-frequency current and a power supply line manufacturing method, which are capable of increasing the positioning accuracy of an inner tube portion with respect to an outer tube portion and capable of enhancing the forming throughput.

Furthermore, the present invention can provide a power supply line holding structure for use in a system such as a trolley system employing a line hanger for fixing a power supply line, which is capable of preventing the power supply line from being removed upward and capable of reliably performing the positioning of the power supply line.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

Embodiments of the present invention will now be described in detail with reference to the accompanying drawings forming a part of the subject specification. In the respective drawings, identical or similar components will be designated by like reference symbols with no repeated description given thereto.

(First Embodiment)

Figure 1:
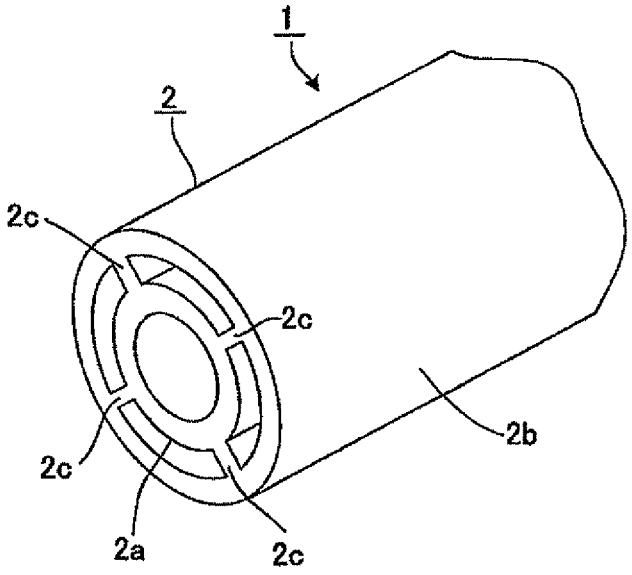
FIG. 1 is a perspective view schematically showing a conductor of a power supply line for high-frequency current according to a first embodiment of the present invention.
Figure 12:
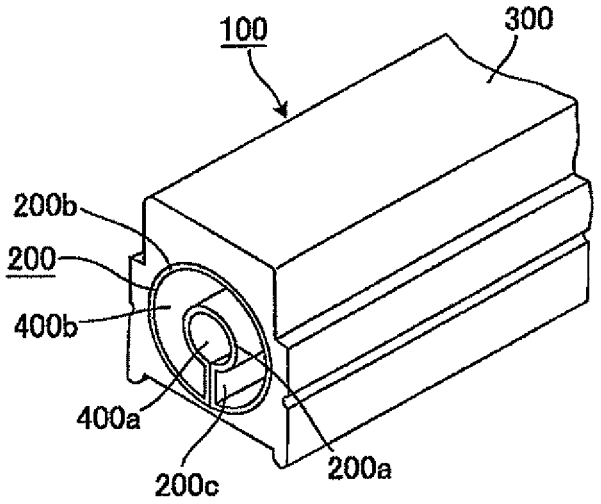
FIG. 12 (PRIOR ART)
FIG. 12 is a perspective view showing the outward appearance of a conventional power supply line for high-frequency current.
Figure 13:
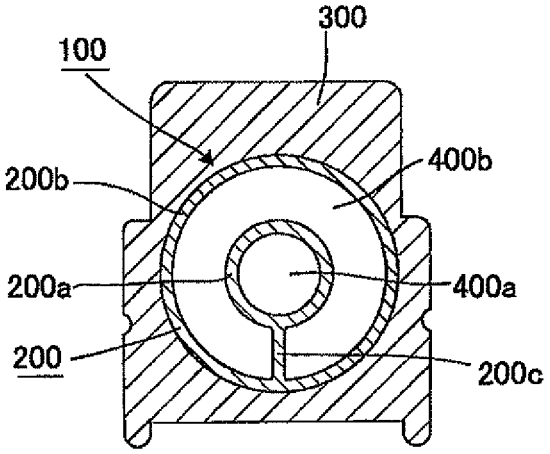
FIG. 13 (PRIOR ART)
FIG. 13 is a vertical section view showing a modified example of the power supply line shown in FIG. 12, which employs another conductor formed by extruding copper.

FIG. 1 is a perspective view schematically showing a conductor of a power supply line for high-frequency current according to a first embodiment of the present invention. Referring to FIG. 1, the power supply line for high-frequency current 1 of the present embodiment includes a two-layered tubular conductor 2. The conductor 2 includes an inner tube portion 2*a* and a concentric outer tube portion 2*b* one-piece connected to the inner tube portion 2*a* by four connecting portions 2*c* over the longitudinal full length of the conductor 2. Just like the conventional power supply line for high-frequency current 100 shown in FIGS. 12 and 13, the conductor 2, when in use, is embedded in an insulating body 300 which is not shown in FIG. 1. The four connecting portions 2*c* interconnecting the inner tube portion 2*a* and the outer tube portion 2*b* are arranged at a specified interval (e.g., at an interval of 90 degrees) in the circumferential direction.

As set forth above, the power supply line 1 of the present embodiment includes the conductor 2 having the four connecting portions 2*c* provided between the inner tube portion 2*a* and the outer tube portion 2*b*. Therefore, as compared with the conventional power supply line 100 in which only one connecting portion 200*c* exists between the inner tube portion 200*a* and the outer tube portion 200*b*, it is possible to increase the positioning accuracy of the inner tube portion 2*a* with respect to the outer tube portion 2*b* and to reduce the high-frequency resistance.

Figure 2:
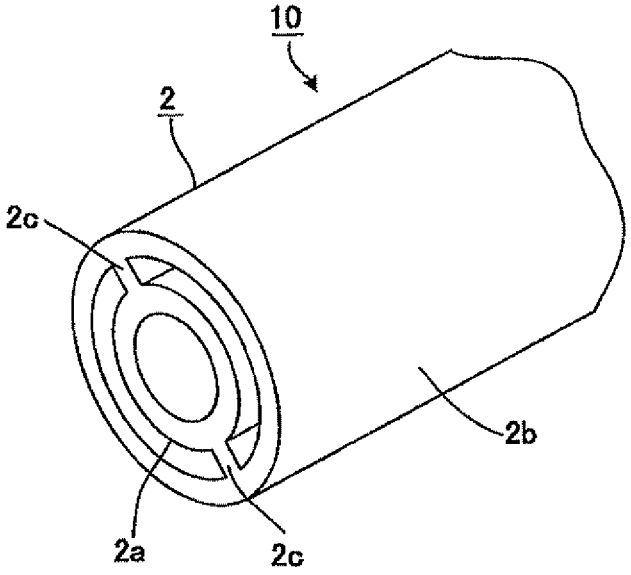
FIG. 2 is a perspective view schematically showing a modified example the conductor of the power supply line shown in FIG. 1, which has two connecting portions.
Figure 3:
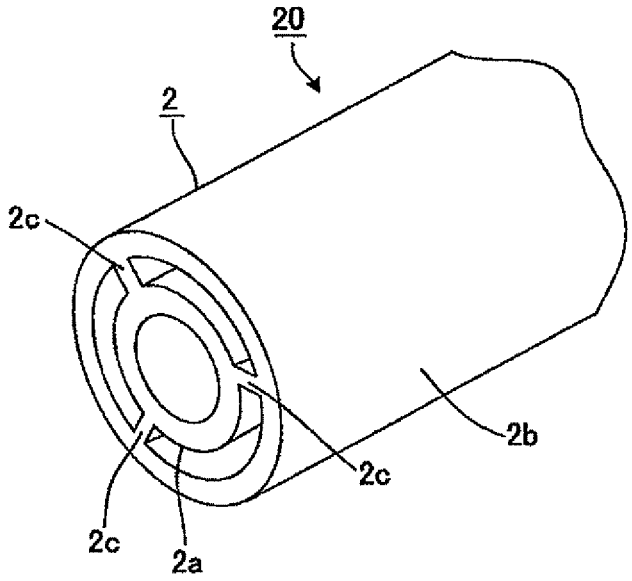
FIG. 3 is a perspective view schematically showing another modified example the conductor of the power supply line shown in FIG. 1, which has three connecting portions.

The number of the connecting portions 2*c* interconnecting the inner tube portion 2*a* and the outer tube portion 2*b* is not limited to four but may be at least two. FIG. 2 schematically shows a power supply line for high-frequency current 10 provided with two connecting portions 2*c*. FIG. 3 schematically shows a power supply line for high-frequency current 20 provided with three connecting portions 2*c*. The connecting portions 2*c* are arranged at an interval of 180 degrees in the power supply line 10 shown in FIG. 2 and at an interval of 120 degrees in the power supply line 20 shown in FIG. 3.

(Second Embodiment)

Figure 4:
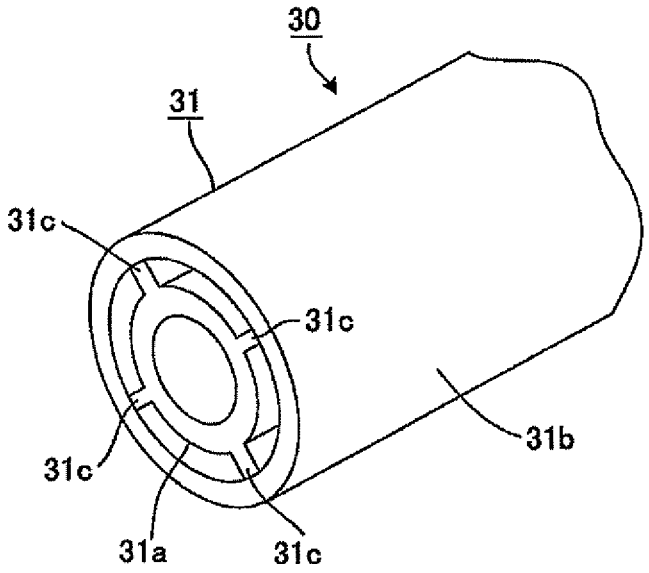
FIG. 4 is a perspective view schematically showing a conductor of a power supply line for high-frequency current according to a second embodiment of the present invention.

FIG. 4 is a perspective view schematically showing a conductor of a power supply line for high-frequency current according to a second embodiment of the present invention. Referring to FIG. 4, the power supply line for high-frequency current 30 of the present embodiment includes a two-layered tubular conductor 31. The conductor 31 includes an inner tube portion 31*a* which has four raised connecting portions 31*c* and an outer tube portion 31*b* into which the inner tube portion 31*a* is inserted. The four raised connecting portions 31*c* of the inner tube portion 31*a* are arranged at a specified interval (e.g., at in interval of 90 degrees) in the circumferential direction of the inner tube portion 31*a* over the longitudinal full length of the inner tube portion 31*a*. The tip ends of the four raised connecting portions 31*c* have such a height that they can make contact with the inner surface of the outer tube portion 31*b*. By providing the four raised connecting portions 31*c* in the inner tube portion 31*a* and bringing the four raised connecting portions 31*c* into contact with the inner surface of the outer tube portion 31*b*, it is possible to form the inner tube portion 31*a* and the outer tube portion 31*b* independently of each other. This makes it possible to enhance the forming throughput and to save the cost.

As described above, the power supply line 30 of the present embodiment is configured such that the four raised connecting portions 31*c* are provided in the inner tube portion 31*a* to make contact with the inner surface of the outer tube portion 31*b*. This makes it possible to form the inner tube portion 31*a* and the outer tube portion 31*b* independently of each other. As compared with a conventional example in which an inner tube portion and an outer tube portion are one-piece formed from a single copper plate, it is possible to enhance the forming throughput and to save the cost.

The number of the raised connecting portions 31*c* is not limited to four but may be at least two as in the first embodiment described earlier.

(Third Embodiment)

Figure 5:
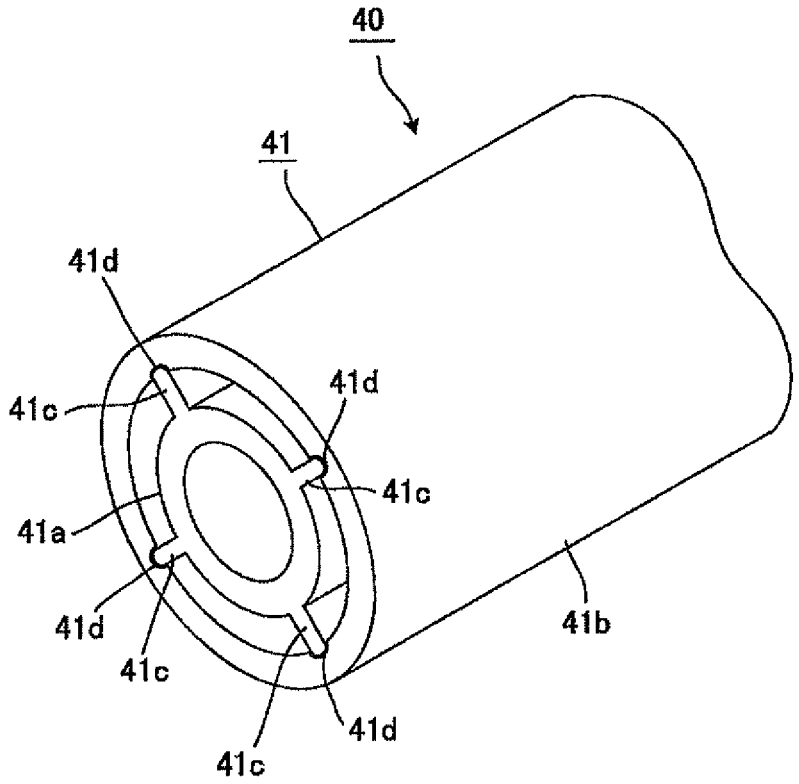
FIG. 5 is a perspective view schematically showing a conductor of a power supply line for high-frequency current according to a third embodiment of the present invention.

FIG. 5 is a perspective view schematically showing a conductor of a power supply line for high-frequency current according to a third embodiment of the present invention. Referring to FIG. 5, the power supply line for high-frequency current 40 of the present embodiment includes a two-layered tubular conductor 41. The conductor 41 includes an inner tube portion 41*a* which has four raised connecting portions 41*c* and an outer tube portion 41*b* into which the inner tube portion 41*a* is inserted. The power supply line 40 of the present invention remains the same as the power supply line 30 of the second embodiment in that the inner tube portion 41*a* is provided with the four raised connecting portions 41*c* but differs from the power supply line 30 of the second embodiment in that guide grooves 41*d* for engaging with the raised connecting portions 41*c* are formed on the inner surface of the outer tube portion 41*b*.

The tip ends of the raised connecting portions 41*c* of the inner tube portion 41*a* are formed into a substantially arc shape. Likewise, the guide grooves 41*d* of the outer tube portion 41*b* are formed into a substantially arc shape. By forming the tip ends of the raised connecting portions 41*c* to have a round shape and forming the guide grooves 41*d* into an arc shape, it is possible to easily bring the raised connecting portions 41*c* into engagement with the guide grooves 41*d*.

Since the guide grooves 41*d* engaging with the raised connecting portions 41*c* are formed on the inner surface of the outer tube portion 41*b* in the power supply line 40 of the present embodiment, it is possible to increase the positioning accuracy of the inner tube portion 41*a*. More specifically, depending on the machining accuracy of the inner surface of the outer tube portion 41*b*, a deviation may sometimes occur in the position of the inner tube portion 41*a* if the inner tube portion 41*a* is rotated with respect to the outer tube portion 41*b* in the circumferential direction. By fixing the tip ends of the raised connecting portions 41*c* of the inner tube portion 41*a* to the guide grooves 41*d* of the outer tube portion 41*b*, it is possible to prevent the inner tube portion 41*a* from being deviated in position from the outer tube portion 41*b*. It goes without saying that the positional deviation may be caused by the machining accuracy of the tip ends of the raised connecting portions 41*c* as well as the machining accuracy of the inner surface of the outer tube portion 41*b*.

While the guide grooves 41*d* and the raised connecting portions 41*c* are formed into a round shape in the present embodiment, they may be formed to have other shapes, e.g., a triangular shape. The number of the raised connecting portions 41*c* is not limited to four but may be at least two as in the first embodiment described earlier.

(Fourth Embodiment)

Figure 6:
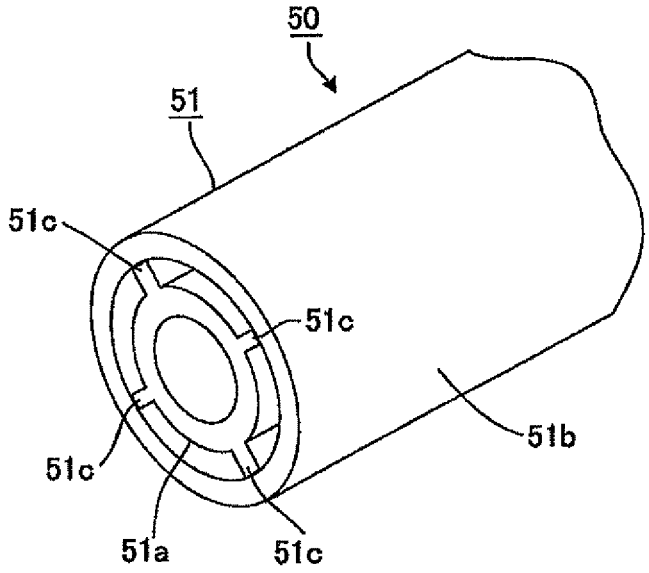
FIG. 6 is a perspective view schematically showing a conductor of a power supply line for high-frequency current according to a fourth embodiment of the present invention.

FIG. 6 is a perspective view schematically showing a conductor of a power supply line for high-frequency current according to a fourth embodiment of the present invention. Referring to FIG. 6, the power supply line for high-frequency current 50 of the present embodiment includes a two-layered tubular conductor 51 just like the power supply line 30 of the second embodiment. The conductor 51 includes an inner tube portion 51*a* which has four raised connecting portions 51*c* and an outer tube portion 51*b* into which the inner tube portion 51*a* is inserted. The power supply line 50 of the present embodiment differs from the power supply line 30 of the second embodiment in that the raised connecting portions 51*c* are pressed against the inner surface of the outer tube portion 51*b*. By pressing the raised connecting portions 51*c* against the inner surface of the outer tube portion 51*b*, it is possible to fix the inner tube portion 51*a* to the outer tube portion 51*b* as in the power supply line 30 of the second embodiment. This makes it possible to prevent positional deviation of the inner tube portion 51*a* with respect to the outer tube portion 51*b*.

Figure 7:
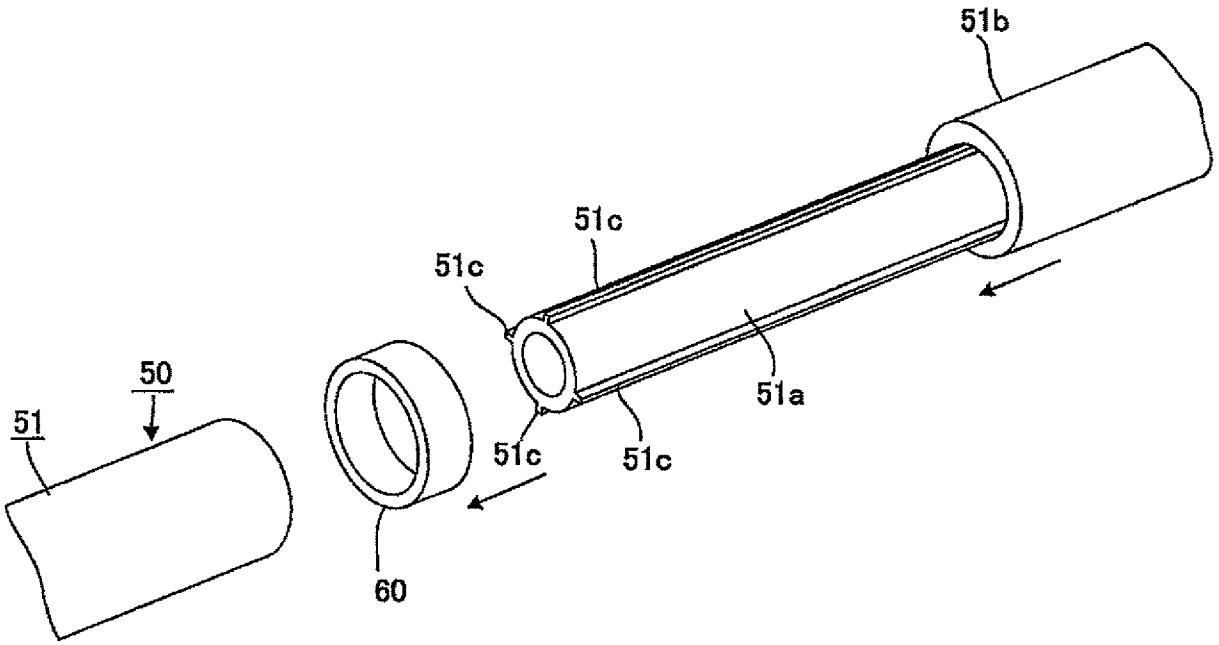
FIG. 7 is a perspective view illustrating a method for manufacturing the power supply line shown in FIG. 6.

FIG. 7 is a perspective view schematically illustrating a method for manufacturing the power supply line 50 of the present embodiment. Referring to FIG. 7, the inner tube portion 51*a* having the four raised connecting portions 51*c* on the outer surface thereof is produced and, then, the outer tube portion 51*b* for holding the raised connecting portions 51*c* on the inner surface thereof is produced. Thereafter, the outer tube portion 51*b* is fitted to the inner tube portion 51*a*. Subsequently, the outer tube portion 51*b* is moved through a ring-shaped die 60 having an inner diameter a little smaller than an outer diameter of the outer tube portion 51*b*, thereby reducing the diameter of the outer tube portion 51*b*. As a result, it is possible to obtain a conductor 51 in which the raised connecting portions 51*c* are kept in close contact with the inner surface of the outer tube portion 51*b*. The conductor 51 is embedded in the afore-mentioned insulating body 300 (see FIGS. 12 and 13) to thereby obtain a power supply line for high-frequency current 50.

In the power supply line 50 of the present invention, the positioning accuracy of the inner tube portion 51*a* can be increased by pressing the raised connecting portions 51*c* of the inner tube portion 51*a* against the inner surface of the outer tube portion 51*b*.

The number of the raised connecting portions 51*c* is not limited to four but may be at least two as in the first embodiment described earlier.

Figure 8:
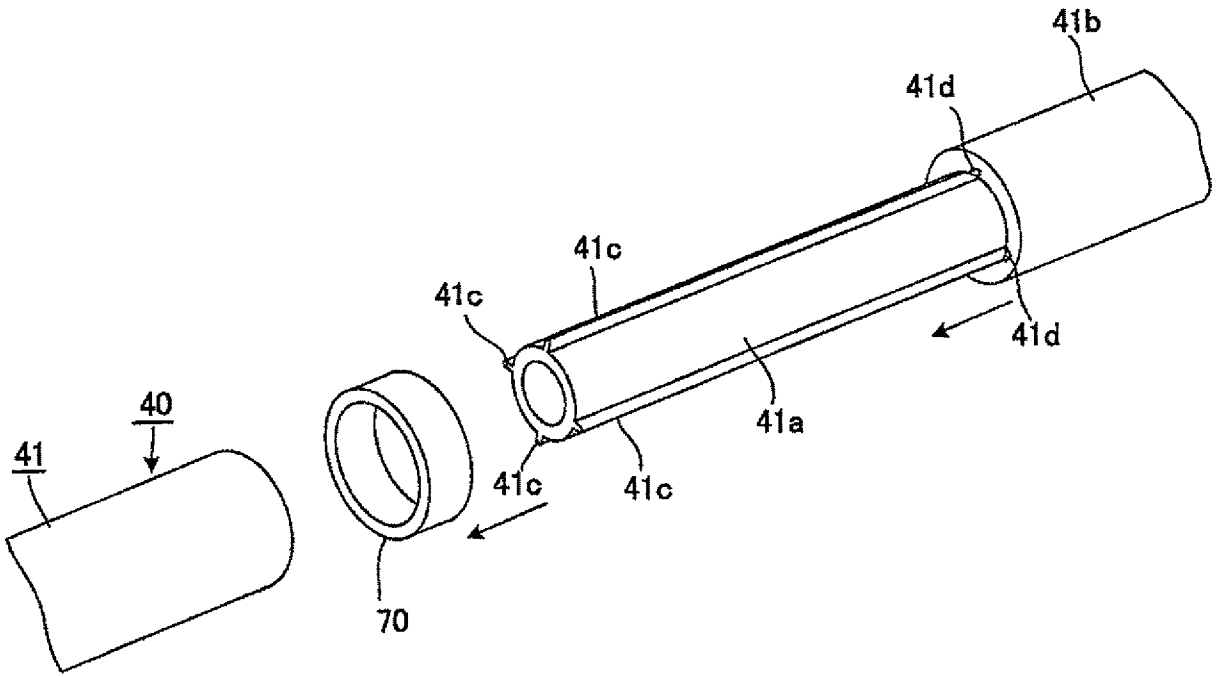
FIG. 8 is a perspective view illustrating a method for manufacturing the power supply line shown in FIG. 5.

In the third embodiment described above, the raised connecting portions 41*c* may be pressed against the inner surface of the outer tube portion 41*b*. FIG. 8 is a perspective view schematically illustrating a method for manufacturing the power supply line 40 of the third embodiment. Referring to FIG. 8, the inner tube portion 41*a* having the four raised connecting portions 41*c* on the outer surface thereof is produced and, then, the outer tube portion 41*b* for holding the raised connecting portions 41*c* on the inner surface thereof is produced. In the production of the inner tube portion 41*a*, the tip ends of the raised connecting portions 41*c* are formed into an arc shape. In the production of the outer tube portion 41*b*, the guide grooves 41*d* are formed to have an arc shape. Thereafter, the outer tube portion 41*b* is fitted onto the inner tube portion 41*a*. Subsequently, the outer tube portion 41*b* is moved through a ring-shaped die 70 having an inner diameter a little smaller than an outer diameter of the outer tube portion 41*b*, thereby reducing the diameter of the outer tube portion 41*b*. As a result, it is possible to obtain a conductor 41 in which the raised connecting portions 41*c* are kept in close contact with the guide grooves 41*d* of the outer tube portion 41*b*. The conductor 41 is embedded in the afore-mentioned insulating body 300 (see FIGS. 12 and 13) to thereby obtain a power supply line for high-frequency current 40.

(Fifth Embodiment)

Figure 9:
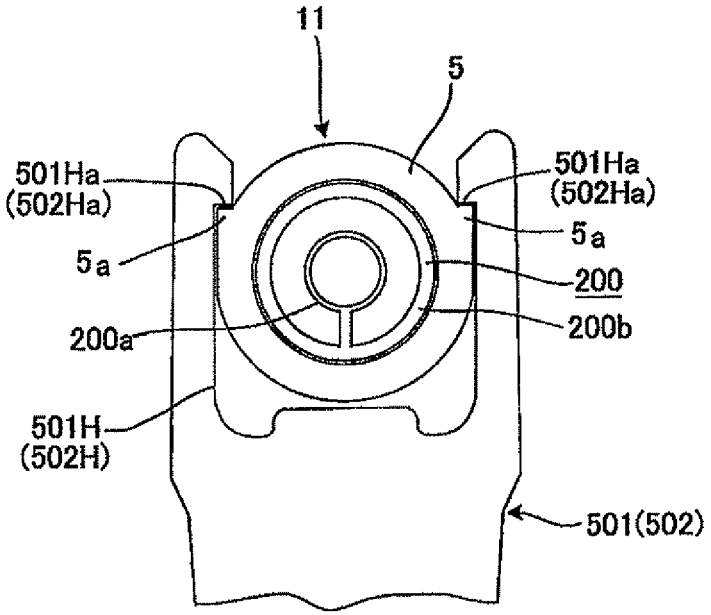
FIG. 9 is a view showing a power supply line holding structure according to a fifth embodiment of the present invention.

FIG. 9 is a view showing a power supply line holding structure according to a fifth embodiment of the present invention. In FIG. 9, the same components as those shown in FIG. 16 are designated by like reference symbols with no description given thereto.

Figure 14:
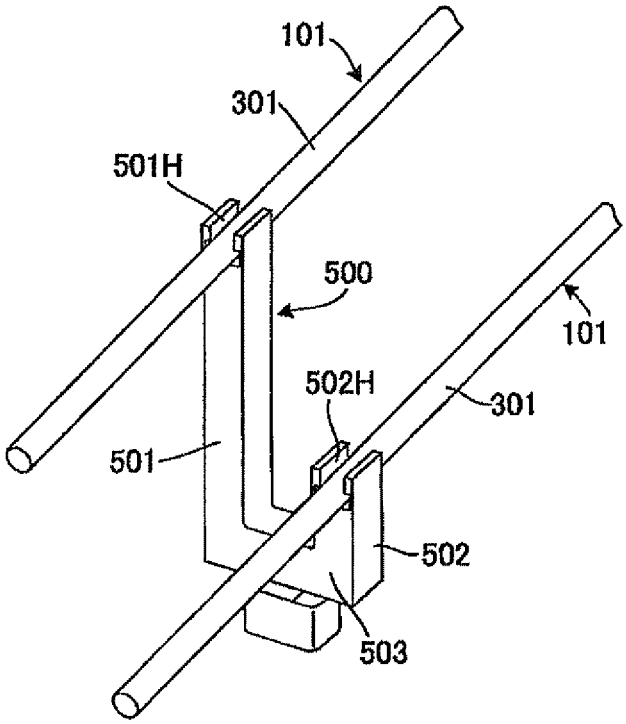
FIG. 14 (PRIOR ART)
FIG. 14 is a perspective view showing a state that two power supply lines are fixed to a conventional line hanger.
Figure 15:
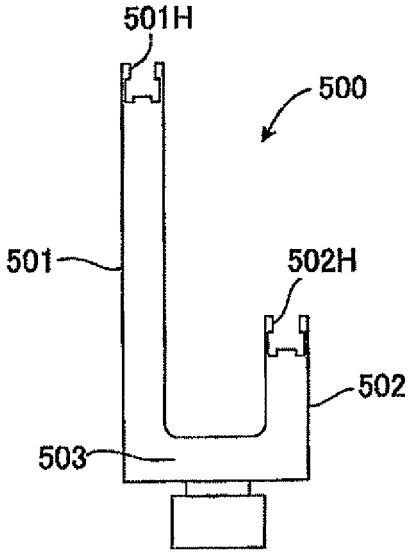
FIG. 15 (PRIOR ART)
FIG. 15 is a front view of the line hanger shown in FIG. 14.

With the power supply line holding structure shown in FIG. 9, a power supply line 11 can be reliably fixed using a line hanger 500 having the same structure as that of the conventional line hanger 500 shown in FIGS. 14 and 15. For the details of the line hanger 500, reference is made to FIGS. 14 and 15.

Figure 16:
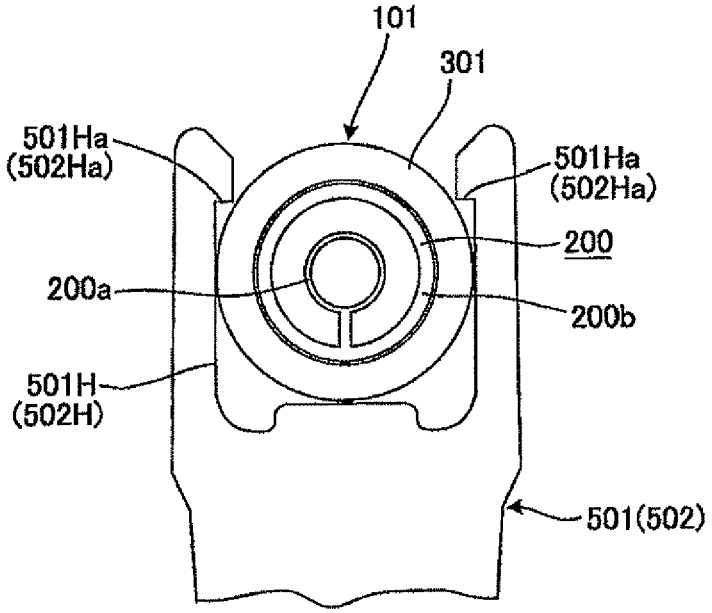
FIG. 16 (PRIOR ART)
FIG. 16 is an enlarged view showing a recess portion of a holding member of a conventional line hanger and a power supply line held in the recess portion.

The power supply line 11 includes the same conductor 200 as that of the conventional power supply line 101 shown in FIG. 16. The power supply line 11 differs from the conventional power supply line 101 in that the sheath 5 of the power supply line 11 has flat shoulder portions 5*a* capable of engaging, through surface-to-surface contact, with the stoppers 501Ha (502Ha) of the recess portion 501H (502H) of the holding member 501 (502) of the line hanger 500. The provision of the flat shoulder portions 5*a* engaging, through surface-to-surface contact, with the stopper pieces 501Ha (502Ha) of the recess portion 501H (502H) of the holding member 501 (502) restrains the power supply line 11 from moving upward. This makes it difficult for the power supply line 11 to be removed upward. Accordingly, it is possible to prevent upward removal of the power supply line 11. In addition, the rotation of the power supply line 11 is restrained by the shoulder portions 5*a*. This prevents the power supply line 11 from making rotation. As a result, it becomes possible to reliably perform the positioning of the power supply line 11.

With the power supply line holding structure of the present embodiment described above, when the power supply line 11 is fixed to the recess portion 501H (502H) of the holding member 501 (502), the flat shoulder portions 5*a* of the sheath 5 of the power supply line 11 are caught, through surface-to-surface contact, by the stoppers 501Ha (502Ha) of the recess portion 501H (502H) of the line hanger 500. This restrains the power supply line 11 from moving upward or making rotation. Accordingly, it is possible to prevent the power supply line 11 from being removed upward and to reliably perform the positioning of the power supply line 11.

(Sixth Embodiment)

Figure 10:
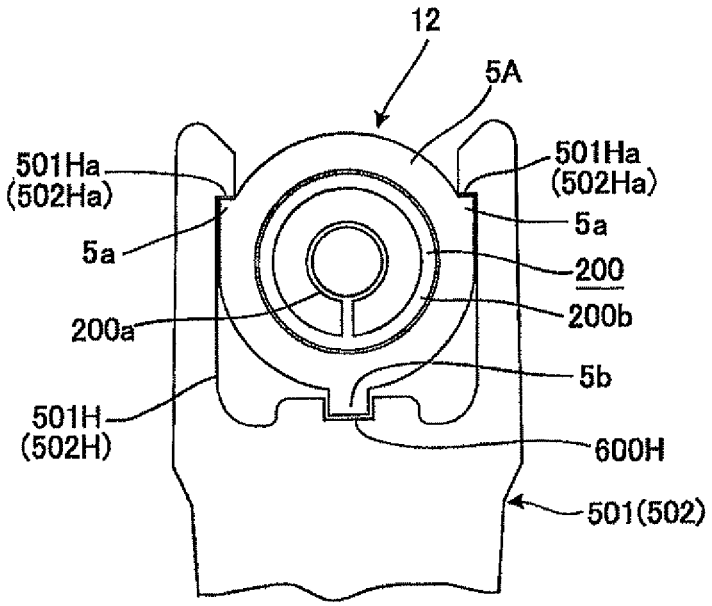
FIG. 10 is a view showing a power supply line holding structure according to a sixth embodiment of the present invention.

FIG. 10 is a view showing a power supply line holding structure according to a sixth embodiment of the present invention. In the power supply line holding structure of the present embodiment, as shown in FIG. 10, a groove 600H is provided on the bottom surface of the recess portion 501H (502H) of the holding member 501 (502) of the line hanger 500. A protrusion 5*b* engaging with the groove 600H of the line hanger 500 is provided in the sheath 5A of a power supply line 12 similar to the power supply line 11 of the fifth embodiment. Since the protrusion 5*b* provided in the sheath 5A of the power supply line 12 engages with the groove 600H provided on the bottom surface of the recess portion 501H (502H) of the holding member 501 (502) of the line hanger 500, the rotation of the power supply line 12 is restrained in a more reliable manner as compared with a case where there is provided only the shoulder portions 5*a*. Accordingly, it is possible to more reliably perform the positioning of the power supply line 12.

With the power supply line holding structure of the present embodiment described above, when the power supply line 12 is fixed to the recess portion 501H (502H) of the holding member 501 (502), the protrusion 5*b* provided in the sheath 5A of the power supply line 12 engages with the groove 600H provided on the bottom surface of the recess portion 501H (502H). This restrains the rotation of the power supply line 12 in a more reliable manner. Accordingly, it is possible to reliably perform the positioning of the power supply line 12 in comparison with that in the power supply line holding structure of the fifth embodiment.

(Seventh Embodiment)

Figure 11:
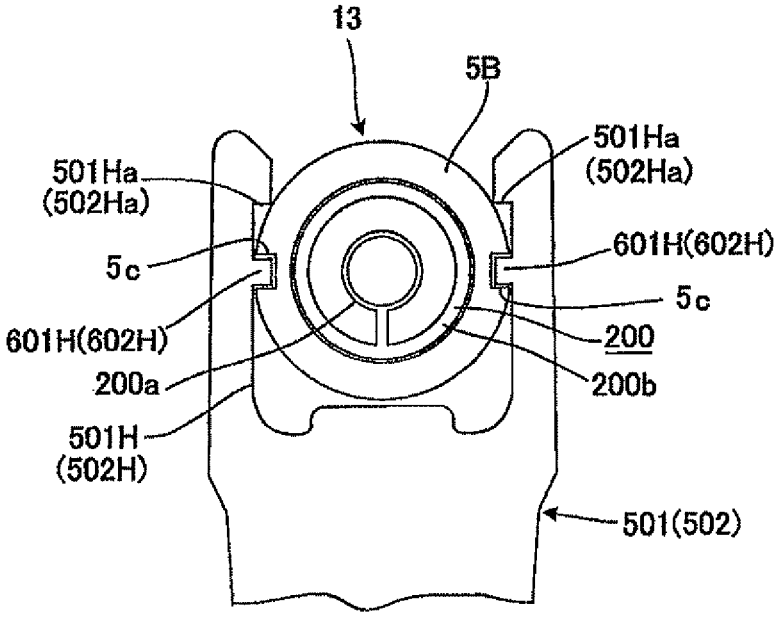
FIG. 11 is a view showing a power supply line holding structure according to a seventh embodiment of the present invention.

FIG. 11 is a view showing a power supply line holding structure according to a seventh embodiment of the present invention. In the power supply line holding structure of the present embodiment, as shown in FIG. 11, protrusions 601H (602H) are provided on the inner side surfaces of the recess portion 501H (502H) of the holding member 501 (502) of the line hanger 500. Grooves 5*c* engaging with the protrusions 601H (602H) of the line hanger 500 are provided in the sheath 55 of a power supply line 13 similar to the power supply line 11 of the fifth embodiment. Since the grooves 5*c* provided in the sheath 5B of the power supply line 13 engages with the protrusions 601H (602H) provided on the inner side surfaces of the recess portion 501H (502H), the rotation of the power supply line 13 is restrained in a more reliable manner as compared with a case where there is provided only the shoulder portions 5*a*. Accordingly, it is possible to more reliably perform the positioning of the power supply line 13. The grooves 5*c* and the protrusions 601H (602H) restrain rotation of the power supply line 13, thereby preventing the power supply line 13 from making rotation. As a result, it becomes possible to reliably perform the positioning of the power supply line 13.

With the power supply line holding structure of the present embodiment described above, when the power supply line 13 is fixed to the recess portion 501H (502H) of the holding member 501 (502), the protrusions 601H (602H) provided on the inner side surfaces of the recess portion 501H (502H) engage with the grooves 5*c* provided in the sheath 5B of the power supply line 13. This restrains the power supply line 13 from moving upward or making rotation. Accordingly, it is possible to prevent the power supply line 13 from being removed upward and to reliably perform the positioning of the power supply line 13.

The fifth through seventh embodiments described above may be provided either independently or in combination. For example, the fifth embodiment and the seventh embodiment may be combined with each other. Alternatively, the sixth embodiment and the seventh embodiment may be combined with each other.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A power supply line for supplying electric power to a vehicle, comprising:

a two-layered tubular conductor including an inner tube portion, an outer tube portion and a plurality of connecting portions provided between the inner tube portion and the outer tube portion, wherein the connecting portions are arranged with a regular interval between two neighboring connecting portions in a circumferential direction of the conductor, wherein the inner tube portion and the outer tube portion are connected to each other by the connecting portions over a longitudinal full length of the conductor, wherein the inner tube portion and the outer tube portion are concentric over the longitudinal full length of the conductor, wherein each of the inner tube portion and the outer tube portion is configured to flow a high-frequency current therethrough, wherein the connecting portions includes raised connecting portions formed on the inner tube portion, the raised connecting portions making contact with an inner surface of the outer tube portion, and wherein the outer tube portion includes guide grooves formed on the inner surface thereof, the raised connecting portions engaging with the guide grooves.

2. The power supply line of claim 1, wherein the raised connecting portions are pressed against the inner surface of the outer tube portion.

3. The power supply line of claim 1, wherein the number of the connecting portions is three or more.

4. The power supply line of claim 1, wherein the guide grooves extend in a lengthwise direction of the outer tube portion.

5. A power supply line for high-frequency current comprising:

a conductor including an inner tube portion, an outer tube portion and a plurality of connecting portions provided between the inner tube portion and the outer tube portion, wherein the connecting portions are arranged with a regular interval between two neighboring connecting portions in a circumferential direction of the conductor, wherein the inner tube portion and the outer tube portion are connected to each other by the connecting portions over a longitudinal full length of the conductor, wherein the connecting portions comprises raised connecting portions formed on the inner tube portion, the raised connecting portions making contact with an inner surface of the outer tube portion, and wherein the outer tube portion includes guide grooves formed on the inner surface thereof, the raised connecting portions engaging with the guide grooves.

6. The power supply line of claim 5, wherein the guide grooves extend in a lengthwise direction of the outer tube portion.

7. The power supply line of claim 5, wherein the raised connecting portions are pressed against the inner surface of the outer tube portion.

8. The power supply line of claim 5, wherein the number of the connecting portions is three or more.

* * * * *